US005500955A

United States Patent [19]

Gongea

[11] Patent Number: 5,500,955

[45] Date of Patent: Mar. 26, 1996

[54] KNEE PAD FOR ATHLETES

[75] Inventor: Adrian-Marius Gongea, Köln, Germany

[73] Assignee: J.G. Karl Schmidt GmbH & Co., Solingen, Germany

[21] Appl. No.: 207,923

[22] Filed: Mar. 8, 1994

[30] Foreign Application Priority Data

Mar. 9, 1993 [DE] Germany ..... 93 03 436 U

[51] Int. Cl.[6] ..... A41D 13/06

[52] U.S. Cl. ..... 2/24; 2/911; 2/267

[58] Field of Search ..... 2/24, 911, 908, 2/267, 268, 22, 44, 45, 16, 62, 2

[56] References Cited

FOREIGN PATENT DOCUMENTS 3433005 3/1985 Germany ..... 2/2

9205717 4/1992 WIPO ..... 2/2

*Primary Examiner*—Paul C. Lewis

*Attorney, Agent, or Firm*—Martin A. Farber

[57] ABSTRACT

The invention relates to a knee pad for athletes which has a cushion part which covers the front and side of the knee and fastening means surrounding parts of the thigh and of the lower leg in the region of the knee, and in order to obtain optimal protection it proposes that the fastening means comprise two fastening strips which are connected, extending approximately parallel, to the cushion part (1) at two different heights, and that the cushion part (1) has a stretchable elastic region (6) between the attachment of the upper fastening strip (2) and the attachment of the lower fastening strip (3), said elastic region connecting two less stretchable cushion regions (4, 5).

18 Claims, 4 Drawing Sheets

KNEE PAD FOR ATHLETES

FIELD AND BACKGROUND OF THE INVENTION

The present invention relates to a knee pad for athletes which has a cushion part which covers the front and side of the knee and fastening means which surround parts of the thigh and lower leg in the region of the knee.

Such knee pads are used in sports in which the athlete must expect regular contact with the ground, particularly in indoor sports such as volleyball and handball. In addition to the elbow, for which special pads of different type of construction are used, the knee, with its various exposed places which will be discussed further below, is particularly sensitive to injury and pain. Knee pads of this type, such as sold for instance by the applicant under the name "protection indoor knee pad" have at least cushioned regions which surround the knee cap (patella), the lateral and medial epicondyles of the thigh bone on the side of the knee cap, the tubercle of the tibia lying below the knee cap on the shinbone (tibia), and the lateral and medial condyles lying to the side thereof. The head of the calf bone (fibula) is preferably also cushioned. In order to be able to hold the cushioned region against the knee even when the knee is bent, the cushion part in the above-mentioned knee pads is divided, in checker form, into individual cushions. The fastening to the knee is effected by a stocking part, the individual cushions being inserted into the stocking part between two layers of textile.

The disadvantage of knee pads of this type is that rubbing movements are necessarily produced between the cushion region and the skin upon the bending of the knee. This is due to the fact that the knee experiences an extension in front in the longitudinal center line, i.e. a connecting line between fixed points on the thigh on the one hand and the shinbone on the other hand is lengthened upon the bending of the knee and shortened upon an extension of the knee. Furthermore, there are corresponding shortenings in the hollow of the knee, i.e. a connecting line between fixed points on the rear of the thigh and on the calf is shortened upon the bending of the knee and lengthened upon the extension of the knee. The elasticity of the material cannot completely compensate for this. Thus, the cushions shift with respect to the underlying regions of the knee which are to be protected, so that optimum protection is obtained only in given positions of the knee. The continuous relative movements can furthermore have the result that the entire knee pad slips into a position in which optimal protection is no longer possible.

SUMMARY OF THE INVENTION

Starting herefrom, the object of the present invention is to provide a knee pad of the aforementioned type which permits improved protection of the exposed parts of the region of the knee regardless of the position of bend of the knee. In this way, the danger of a shifting and sliding of the knee pad in use is at the same time to be reduced.

The fastening means comprise two fastening strips which, at two different heights, adjoin the cushion part extending approximately parallel to each other, one of which can be closed in ring shape together with the cushion part above the knee joint and the other below the knee joint around the thigh and the lower leg respectively, and that the cushion part has, between the attachment of the upper fastening strip and the attachment of the lower fastening strip, a stretchable elastic region which connects two less stretchable cushion regions together, the lower cushion comprising a cushion for the protection of the patella (knee cap).

By invention, the result is obtained, on the one hand, that the knee can be bent without displacement of the attachment parts with respect to each other. Furthermore, the cushion region for the knee cap is carried along with the lower fastening strip in anatomically correct manner in accordance with the bending of the lower leg, so that the knee cap is protected in each case by the individual cushion provided for this both when the joint is bent and when it is extended.

The two cushion regions are displaceable with respect to each other as a result of the elastic region. The elastic region thus facilitates the bending of the knee.

The two cushion regions could, in principle, comprise large-surface cushions which are adapted to the shape of the knee. However, it is more favorable to divide the cushion into individual cushions which serve for the protection of given exposed regions of the knee and are associated with them. The corresponding regions have already been pointed out above.

Thus, in a preferred embodiment, the lower cushion region comprises cushions for the protection of the lateral and medial condyles of the tibia, and the upper cushion region comprises cushions for the protection of the lateral and medial epicondyles of the thigh bone, and finally the lower cushion region comprises, below the cushion for the knee cap, another cushion for the protection of the tubercle of the tibia.

In this connection, furthermore, for instance three similar cushions for the knee cap and the tubercle of the tibia can be arranged substantially in a vertical line one below the other, they being possibly developed, substantially identically in the shape of regular hexagons which lie in honeycomb-like manner with respect to each other with horizontal adjoining lines. Furthermore, it is possible that cushions which laterally adjoin the three said cushions be inserted at least in the connecting region in honeycomb fashion with a boundary angle of about 120°. Each of the adjoining lines permits in this connection a relatively force-free bending of the individual cushions with respect to each other, and thus a three-dimensional adaptation along horizontal and two diagonal intersecting edges.

The elastic region can preferably be of approximately constant width between the two cushion regions, this width being so small that no larger uncushioned zones are produced and, viewed from in front, extend in the shape of a bell curve above the cushion for the knee cap and, in each case, below the cushions for the lateral and medial epicondyles. In this way, once again assurance is had in anatomically correct manner that the two last-mentioned cushions are held substantially immovable with respect to the thigh, regardless of the bending of the knee, while all other cushions shift jointly with respect to the lower leg upon the movement of the latter.

In an embodiment which is favorable from the standpoint of manufacture, both the upper cushion region and the lower cushion region consist of a thinner base layer and cushions placed thereon which differ from each other only in their shape; in other words, the two parts are made of one and the same material, particularly a foam material. In order to increase the bendability and flexibility which have already been mentioned, the base layer between the cushion for the patella and the cushions for the lateral and medial condyles may each have an incision which extends from the outer edge.

The entire cushion part can be constructed in the manner that the two cushion regions with an interposed elastic region are sewn at the corresponding limiting edges. However, it is also possible to sew the cushion regions on a support material, in each case at least along their limiting edges, the support material at the same time forming the elastic region. Instead of sewing, bonding can also be used. For reasons of appearance and in order to increase the slidability of the knee pad on the floor of the hall, the cushion regions can be covered with fabric or preferably laminated. This can easily be done at the same time as a corresponding shaping process. It is also possible to flock the cushion regions only after the shaping process.

The attachment strips, which favorably also consist of textile material, can be produced in one piece with said textile support material. However, it may also be favorable for reasons of manufacture to sew them onto the cushion part.

The two strips can consist of one piece and extend from an edge of the cushion part and up to the other edge of the cushion part and be fastened there. It is also possible to develop each of the fastening strips in two parts in the form of shorter tabs which are then connected together approximately at the center. The lower fastening strip can advantageously be fastened on both ends and closed in ring shape with the cushion part, while only the upper fastening strip can be opened and closed. Closures are provided as suitable and practical means of closure, such as fabric fiber releasable fastening means such as a VELCRO closure, for the fastening strips.

DRAWINGS

With the above and other objects and advantages in view, the present invention will become more clearly understood in connection with the detailed description of preferred embodiments, when considered with the accompanying drawings, of which:

DETAILED DESCRIPTION OF THE PREFERRED EMBODIMENTS

A knee pad for the left knee would be symmetrical to this, namely mirrored in front view along a vertical central plane. Knee pads for both knees can, however, also be made uniform by symmetrical development.

Figure 1:
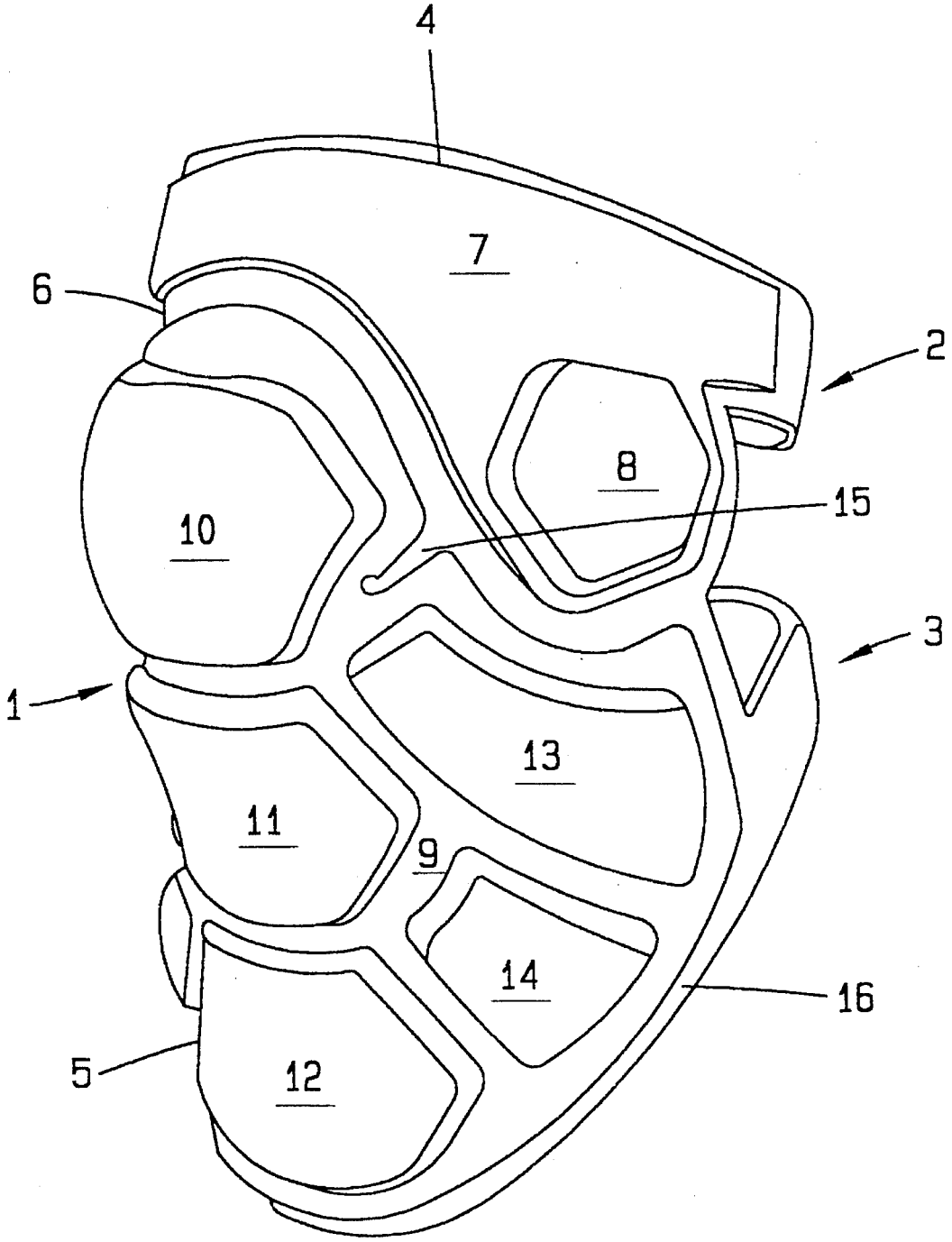
FIG. 1 shows a knee pad for a right knee in accordance with the invention, seen in perspective.

FIG. 1 shows a knee pad having a cushion part I and attached fastening strips 2, 3. The cushion part 1 surrounds the front parts of the knee while the fastening strips are adapted to be placed around the thigh and the lower leg directly above and below the hollow of the knee respectively. The cushion part 1 consists of an upper cushion region 4 and a lower cushion region 5, between which an elastic region 6 is provided. In the embodiment shown, the elastic region consists of a support layer 16 for the cushion regions 4 and 5 and at the same time forms the fastening strips 2 and 3 integral with it. The cushion region 4 consists of a thinner base layer 7 and cushions placed thereon, one (8) of said cushions, placed on for the medial epicondyle, can be noted. The cushion region 5 consists of a thinner base layer 9 which bears a plurality of cushions, there being shown in particular the cushion 10 for the protection of the patella, the cushions 11 and 12 for the protection of the tubercle of the tibia, as well as cushions 13, 14 for the protection of the medial condyle. Each of the cushions 10, 11 and 12 is a hexagon, adjoining each other with horizontal edges while maintaining a certain distance apart. The cushions 13 and 14 adjoin same laterally at angles of about 120° in the connecting region. Between the cushions 10 and 13 there is an incision 15 in the material of the thinner base layer in order to increase the flexibility of the cushion part. The cushions are bonded or sewn onto the support material 16, which also forms the elastic region 6.

Figure 3:
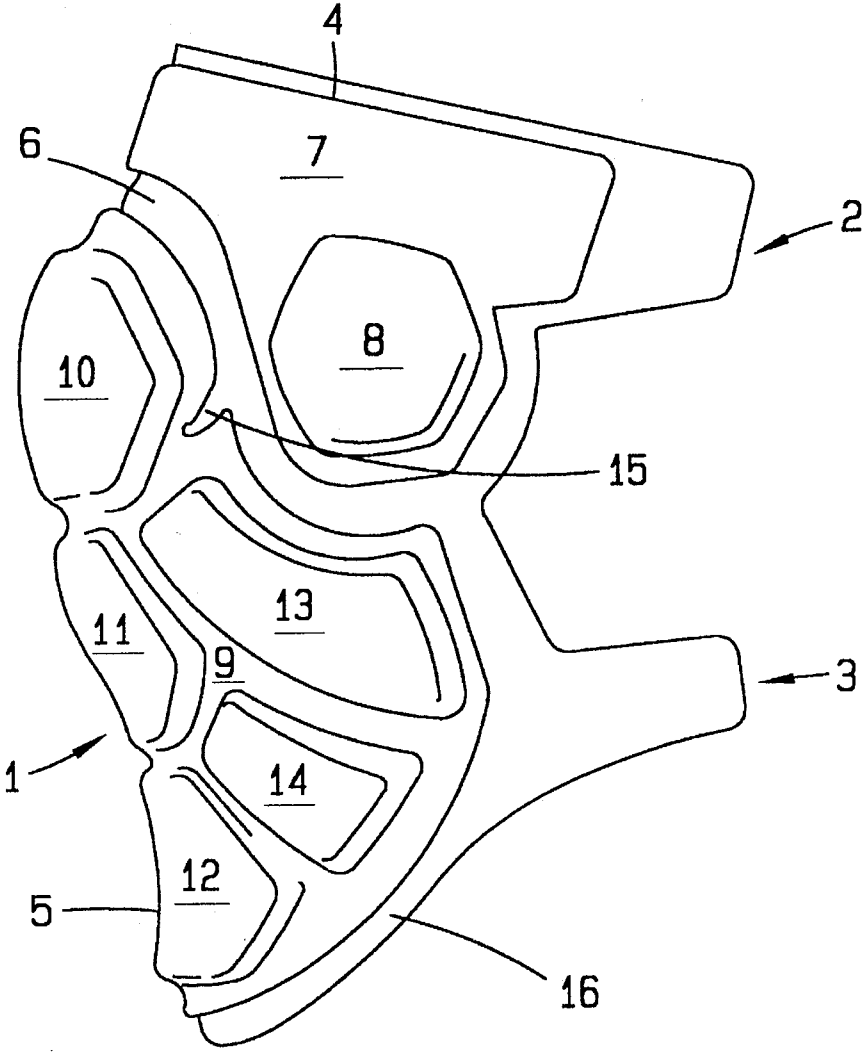
FIG. 3 shows a knee pad according to FIG. 1 of the invention in side view.
Figure 2:
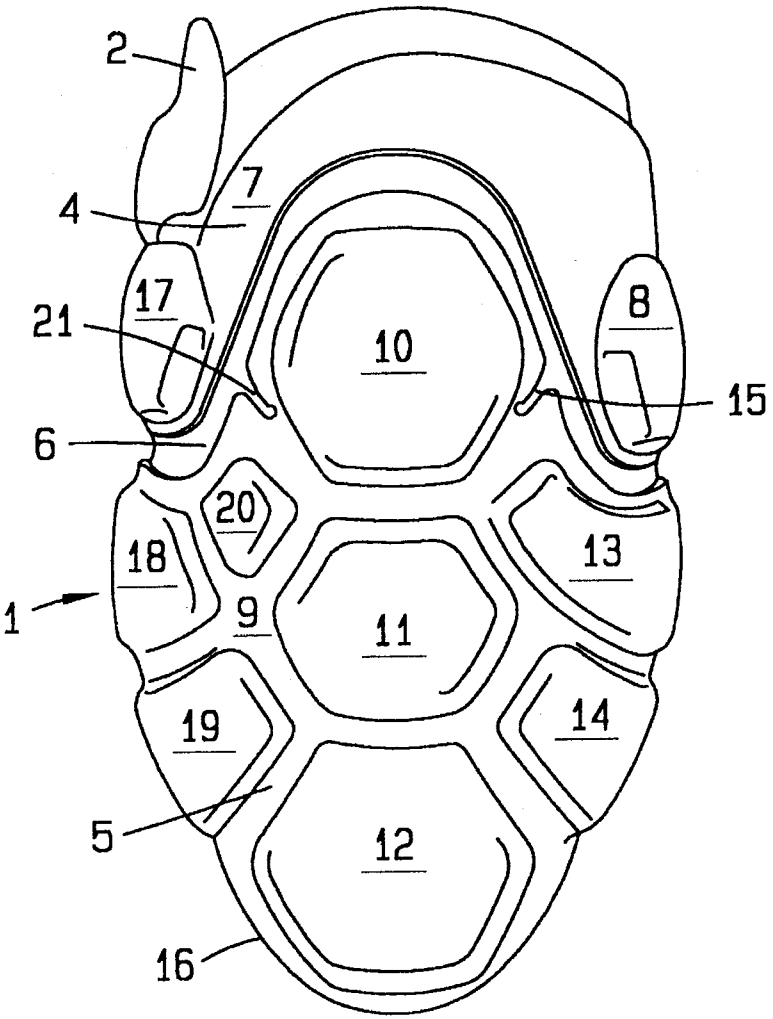
FIG. 2 shows the knee pad of FIG. 1 in accordance with the invention in a front view.

In FIGS. 2 and 3, which will be described together below, parts corresponding to FIG. 1 are provided with the same reference numerals. This will be described further below. In FIG. 2, as compared with FIG. 1, there can furthermore be noted the free end of the fastening strip 2, which can be fixed on the support material 16, in particular by means of a fabric fiber releasable fastening means such as a VELCRO closure. It can furthermore be noted that, opposite the cushion 8, an approximately symmetrical cushion 17 for the lateral epicondyle is developed on the upper cushion region 4. It can furthermore be noted that, opposite the elongated cushion 13 for the medial condyle, there are two individual cushions 20, 18 for the lateral condyle, while opposite the cushion 14 there is symmetrically arranged an approximately identical cushion 19 for the head of the fibula.

Figure 4B:
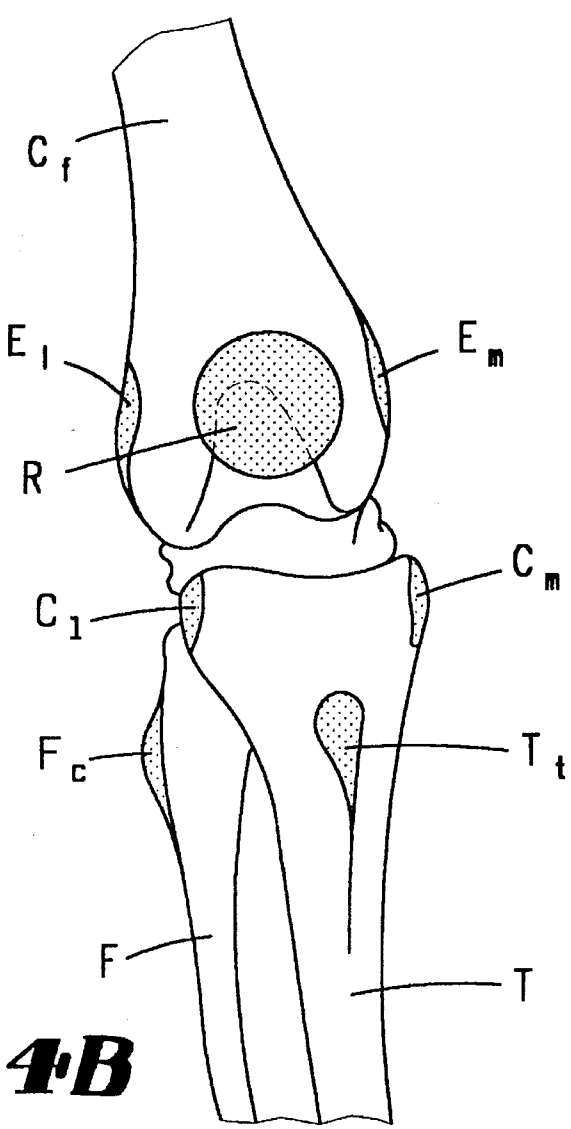
FIG. 4 shows the bones in the region of the knee as details, in both side and front views.
Figure 4A:
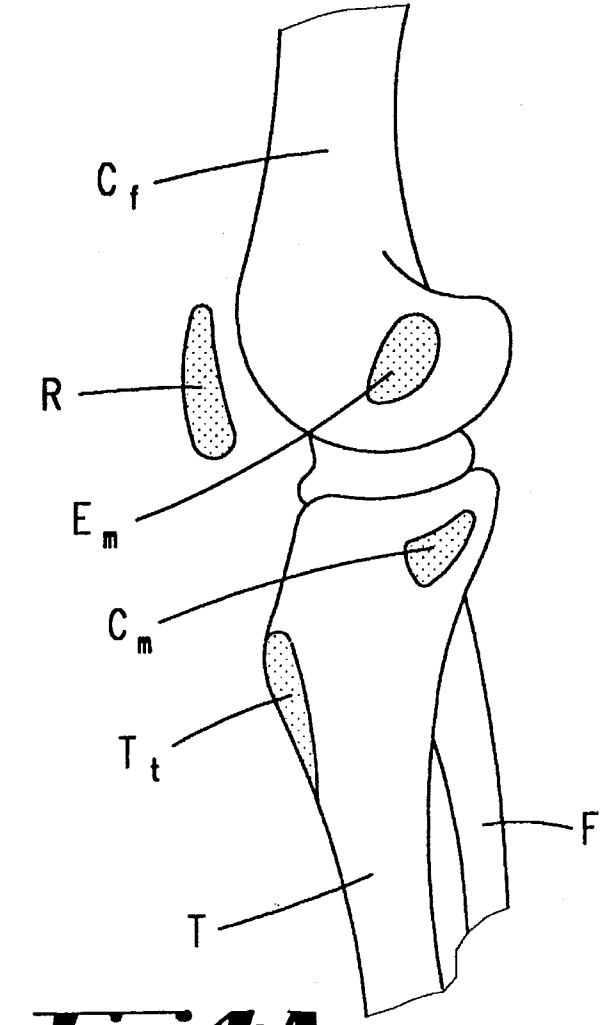

In FIG. 4, the bones which come together in the region of the knee are shown in front view and in side view, the exposed regions which are sensitive to injury and pain being indicated in each case in the drawing. In detail, there can be noted in this connection the thigh bone $C_f$ (femur) and, formed thereon, the lateral epicondyle $E_1$ and the medial epicondyle $E_m$. There can further be noted the tibia T (shinbone) and the fibula F (calf bone); on the former, the lateral condyle $C_1$ and the medial condyle $C_m$ as well as the tubercle of the tibia $T_t$ are marked. On the fibula, the head of the fibula $F_c$ is particularly marked. The patella R (knee cap) is spaced from the lower end of the thigh bone.

Figure 5:
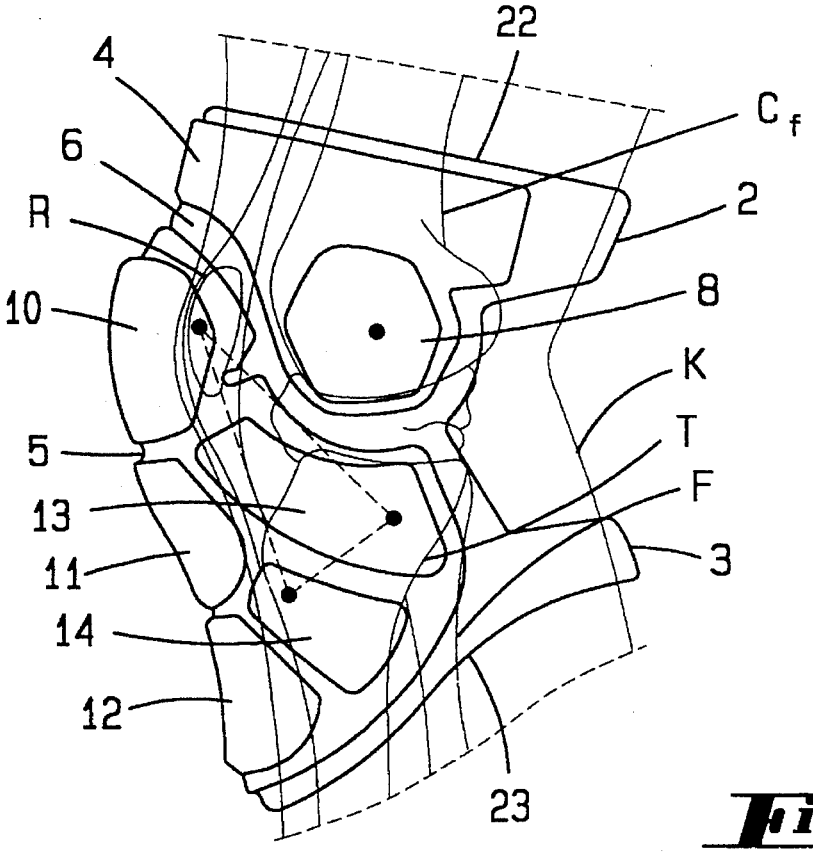
FIG. 5 shows a knee pad according to FIG. 1 of the invention in side view with the knee extended, the bone parts of the knee being shown in thin lines.
Figure 6:
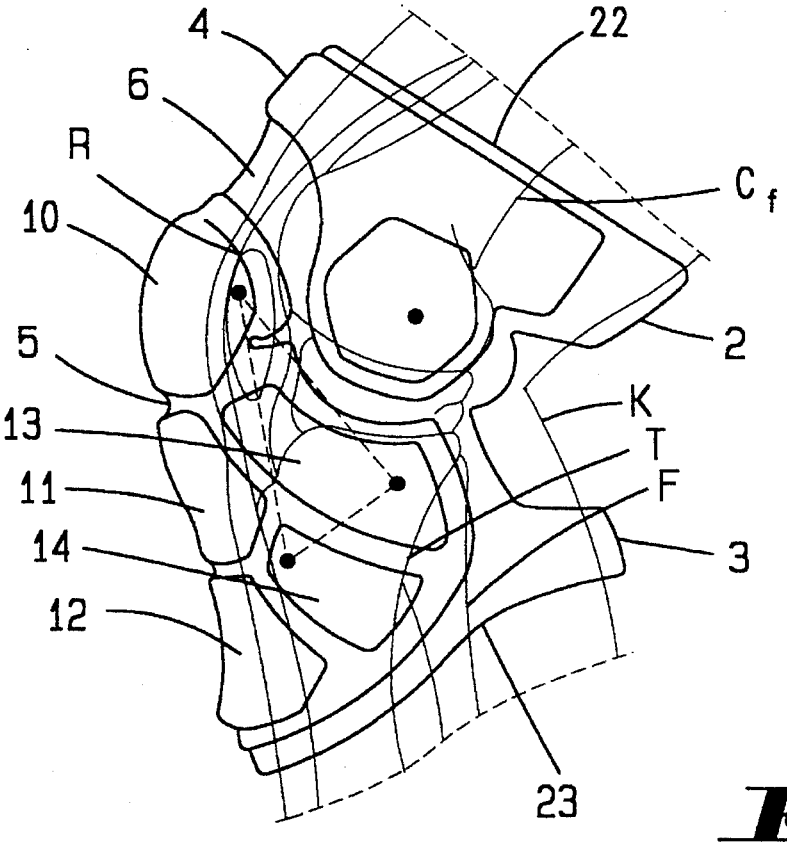
FIG. 6 shows the knee pad according to FIG. 1 of the invention seen in side view with the knee bent, the bone parts of the knee being shown in thin lines.

FIGS. 5 and 6 show a knee pad in a view similar to FIG. 3, but in extended position in FIG. 5 and in bent position in FIG. 6. In this connection, in each case the contour of the knee region K as well as parts of the aforementioned bones in associated position are shown in thin lines. It can be noted in this connection that the geometry of an imaginary triangle which is formed of an imaginary point on the cushion 10 and imaginary points on the cushions 13 and 14 changes only insignificantly with respect to the bone parts patella R and tibia T upon the bending of the joint which takes place with an elongation of the elastic region 6, and that the same is true of the point on the cushion 8 with respect to the thigh bone $C_f$. On the other hand, the courses of the upper edge 22 with respect to the lower edge 23 of the knee pad, which are formed essentially by the fastening strips 2, 3, clearly change.

I claim:

1. A knee pad for athletes, the knee pad comprising:

a cushion part which covers the front and side of the knee, and fastening means which surround parts of the thigh and of the lower leg in the region of the knee;

wherein the fastening means comprise two fastening strips which, at two different heights, adjoin the cushion part, the two fastening strips extending approximately parallel to each other;

the two fastening strips are closable in ring shape with the cushion part around the thigh and lower leg respectively;

the cushion part has three middle cushions lying one below the other and abutting each other with horizontal abutment lines, an upper one of said middle cushions protecting the knee cap, and a lower one of said middle cushions protecting the shinbone, and each of said middle cushions having essentially a hexagonal shape;

the cushion part further comprises two lateral cushions, a first of said lateral cushions lying above a second of said lateral cushions, said two lateral cushions adjoining said three middle cushions in a honeycomb arrangement; and a first imaginary point located on said upper middle cushion and a second imaginary point located on said first lateral cushion and a third imaginary point located on said second lateral cushion are vertices of an imaginary triangle, said knee pad including means for preventing geometry of the triangle from changing significantly with respect to the knee cap and the shinbone upon a bending of the knee.

2. A knee pad according to claim 1, wherein said means for preventing comprises, said cushion part further comprising, between said two fastening strips, a stretchable elastic region, and an upper stretchable cushion region and a lower stretchable cushion region which are connected to said elastic region, the upper and the lower cushion regions being less stretchable than said elastic region; and said lower cushion region includes said middle cushions and said lateral cushions.

3. A knee pad according to claim 2, wherein the lower cushion region further comprises a third lateral cushion located on a side of said middle cushions opposite said first lateral cushion for the protection of the lateral and medial condyles of the tibia.

4. A knee pad according to claim 2, wherein the upper cushion region comprises a first upper lateral cushion and a second upper lateral cushion which are located on opposite sides of said upper middle cushion for the protection of the lateral and medial epicondyles of the thigh bone.

5. A knee pad according to claim 2, wherein in the lower cushion region, a central one of said middle cushions is located between said upper middle cushion and said lower middle cushion for the protection of the tubercle of the tibia.

6. A knee pad according to claim 2, wherein said three middle cushions are arranged in a substantially vertical line.

7. A knee pad according to claim 6, wherein the lower cushion region further comprises a third lateral cushion and a fourth lateral cushion located on a side of said middle cushions opposite said first and said second lateral cushions, said lateral cushions meeting said middle cushions with boundary angles of about 120° in honeycomb form in a connection region.

8. A knee pad according to claim 7, wherein both the upper cushion region and the lower cushion region each comprises a base layer thinner than said cushions, and wherein all of said cushions are located on said base layers.

9. A knee pad according to claim 8, wherein each of the cushions are connected to a respective of said base layers as one piece made of a foam material.

10. A knee pad according to claim 8, wherein each of the base layers is self supporting and the elastic region adjoins edges thereof.

11. A knee pad according to claim 8, further comprising a support material and wherein the base layers are applied to the support material, the support material serving as the elastic region.

12. A knee pad according to claim 8, wherein a lower of the base layers has, in order to increase mobility, an incision extending from the elastic region between the upper middle cushion and the first lateral cushion and respectively the upper middle cushion and the third lateral cushion.

13. A knee pad according to claim 2, wherein the fastening strips connect respectively with the upper and the lower cushion regions.

14. A knee pad according to claim 11, wherein the fastening strips are formed as a single piece with the support material.

15. A knee pad according to claim 1, further comprising fabric fiber closure means arranged on the free ends of at least the upper fastening strip.

16. A knee pad according to claim 4, wherein the elastic region is approximately of constant width and, as seen in front view, extends in the manner of a bell curve over the upper middle cushion and below the upper lateral cushions of the upper cushion region.

17. A knee pad according to claim 11, wherein said support material is a textile, and at least one of said base layers is sewn to said support material.

18. A knee pad according to claim 13, wherein the fastening strips are sewn to the cushion regions.

* * * * *